US008948670B2

(12) United States Patent
Nakamura et al.

(10) Patent No.: US 8,948,670 B2
(45) Date of Patent: Feb. 3, 2015

(54) FIXING APPARATUS AND IMAGE FORMING APPARATUS INCLUDING THE SAME

(75) Inventors: Hirokazu Nakamura, Osaka (JP); Masatsugu Ohishi, Osaka (JP); Noriko Inoue, Osaka (JP); Masaki Amemiya, Osaka (JP); Masaya Asakawa, Osaka (JP); Takashi Yamanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 834 days.

(21) Appl. No.: 13/105,963

(22) Filed: May 12, 2011

(65) Prior Publication Data

US 2011/0280636 A1 Nov. 17, 2011

(30) Foreign Application Priority Data

May 13, 2010 (JP) ..... 2010-111392
May 13, 2010 (JP) ..... 2010-111394

(51) Int. Cl.
*G03G 15/20* (2006.01)

(52) U.S. Cl.
CPC ..... *G03G 15/2075* (2013.01)
USPC ..... 399/327

(58) Field of Classification Search
CPC ..... G03G 15/2067; G03G 15/2075
USPC ..... 399/327–329
See application file for complete search history.

(56) References Cited

U.S. PATENT DOCUMENTS

| | | | |
|---|---|---|---|
| 5,168,314 | A | 12/1992 | Gunji et al. |
| 6,091,925 | A | 7/2000 | Sugimoto et al. |
| 2010/0046995 | A1 | 2/2010 | Nakamura et al. |

FOREIGN PATENT DOCUMENTS

| | | | |
|---|---|---|---|
| JP | 59-048783 | A | 3/1984 |
| JP | 2-280181 | A | 11/1990 |
| JP | 8-185074 | A | 7/1996 |
| JP | 9-197884 | A | 7/1997 |
| JP | 10-198213 | A | 7/1998 |
| JP | 11-344105 | A | 12/1999 |
| JP | 2003-263058 | A | 9/2003 |
| JP | 2004-302029 | A | 10/2004 |
| JP | 2008-145718 | A | 6/2008 |
| JP | 2010-48964 | A | 3/2010 |

*Primary Examiner* — David M. Grey
*Assistant Examiner* — Erika J Villaluna
(74) *Attorney, Agent, or Firm* — Birch, Stewart, Kolasch & Birch, LLP

(57) ABSTRACT

A fixing apparatus of the present invention includes a fixing rotation member, a rotation drive portion that rotates the fixing rotation member, a cleaning web sheet that cleans a circumferential surface of the fixing rotation member, a cleaning web sheet roller that takes up or feeds out the cleaning web sheet, a swing cam rotationally driven by the rotation drive portion, a rotation transmission portion that transmits a rotation drive force to the cleaning web sheet roller, a one way clutch provided on an input shaft of the rotation transmission portion, and a swing lever connected to the one way clutch and biased so as to be brought into slide contact with the swing cam.

13 Claims, 10 Drawing Sheets

FIXING APPARATUS AND IMAGE FORMING APPARATUS INCLUDING THE SAME

CROSS-REFERENCE TO RELATED APPLICATION

This application claims priority under 35 U.S.C. §119(a) on Patent Application No. 2010-111392 filed in Japan on May 13, 2010, and Patent Application No. 2010-111394 filed in Japan on May 13, 2010, the entire contents of which are herein incorporated by reference.

BACKGROUND OF THE INVENTION

1. Field of the Invention

The present invention relates to a fixing apparatus that fixes a toner image formed on a recording sheet and an image forming apparatus including the same.

2. Description of the Related Art

A fixing apparatus of this type is applied to an image forming apparatus that uses an electrophotographic method, an electrostatic recording method, a magnetic photographic method, or the like. Such a fixing apparatus heats and presses a recording sheet (such as plain paper, electrostatic recording paper, or photographic paper) onto which a toner image has been transferred, the recording sheet being sandwiched between a pair of fixing rotation members (belt, roller), and thereby fixes the toner image on the recording sheet.

In such a fixing apparatus, the circumferential surface of a fixing rotation member may become smeared due to toner and the like, and thus it is necessary to clean the circumferential surface of the fixing rotation member using a blade, felt, a web sheet, or the like. Further, if the processing speed of the image forming apparatus is fast, and the number of sheets to be printed per unit time is large, smearing on the fixing rotation member of the fixing apparatus increases, and thus the smearing cannot be completely removed by cleaning the fixing rotation member using a blade or felt. Thus, cleaning using a web sheet is often adopted.

For example, in the fixing apparatus disclosed in JP H8-185074A (hereinafter, referred to as Patent Document 1), a web sheet is fed out from a feed roller and taken up by a take-up roller, and the web sheet is pushed against a fixing roller during the feeding-out and taking-up operation, thereby cleaning the circumferential surface of the fixing roller. Further, the take-up roller is driven by a motor so as to rotate at a low speed, thereby taking up and feeding out the web sheet.

In the fixing apparatus disclosed in JP H9-197884A (hereinafter, referred to as Patent Document 2), a web driving solenoid is used in order to drive a take-up roller that takes up a web sheet. Moreover, the amount by which the web sheet is taken up is adjusted according to image density.

However, even if smearing on a fixing rotation member can be effectively removed by adopting cleaning using a web sheet, if a motor or a solenoid for rotating the web sheet take-up roller at a low speed is provided as with the case of the fixing apparatuses disclosed in Patent Documents 1 and 2, this results in an increase in power consumption and a rise of cost compared with using a blade or felt.

On this account, it is conceivable to use a motor for rotating a fixing rotation member as a motor for rotating a web sheet take-up roller. In this case, the rotational speed of the web sheet take-up roller is very slow, compared with the rotational speed of the fixing rotation members, and thus a great speed reduction ratio will be necessary.

However, for example, in a configuration in which the distance between the shafts of the fixing rotation members is changed according to the thickness of a recording sheet, the positional relationship among the shaft of the web sheet take-up roller and the shafts of fixing rotation members also changes. Thus, it was difficult to constitute a power transmission mechanism that can rotate both a fixing rotation member and the web sheet take-up roller using one motor, and can sufficiently increase the speed reduction ratio of the web sheet take-up roller.

Further, in the case where the motor for rotating a fixing rotation member is used as a motor for rotating the web sheet take-up roller, it was difficult to adjust the amount by which the web sheet is taken up since the fixing rotation members and the web sheet take-up roller are caused to operate in conjunction with each other. For example, if the process speed is switched and set according to a color image or a monochrome image, the amount by which the web sheet is taken up also changed, and thus the take-up amount was not able to be accurately set.

SUMMARY OF THE INVENTION

In view of this, a first object of the present invention is to provide a fixing apparatus that can cause fixing rotation members and a take-up roller for a web sheet to rotate at respectively appropriate rotational speeds using one drive source, and rotate the take-up roller for the web sheet and the fixing rotation members together even if the positional relationship among the shaft of the take-up roller for the web sheet and the shafts of the fixing rotation members changes, and an image forming apparatus including the same.

Further, a second object of the present invention is to provide a fixing apparatus that can cause fixing rotation members and a take-up roller for a web sheet to rotate at respectively appropriate rotational speeds using one drive source, and adjust the amount by which the web sheet is taken up.

In order to achieve the above first object, a fixing apparatus of the present invention includes a fixing rotation member, a rotation drive portion that rotates the fixing rotation member, a cleaning web sheet that cleans a circumferential surface of the fixing rotation member, a cleaning web sheet roller that takes up or feeds out the cleaning web sheet, a swing cam that is rotationally driven by the rotation drive portion, a rotation transmission portion that transmits a rotation drive force to the cleaning web sheet roller, a one way clutch that is provided on an input shaft of the rotation transmission portion, a swing lever that is connected to the one way clutch and biased so as to be brought into slide contact with the swing cam, and a separating portion that separates the swing lever from the swing cam, wherein if the swing cam is rotated by the rotation drive portion, the swing lever that is in slide contact with the swing cam repeatedly swings, the swinging of the swing lever is transmitted as an intermittent one-way rotation to the input shaft of the rotation transmission portion via the one way clutch, and the intermittent rotation is transmitted to the cleaning web sheet roller via the rotation transmission portion.

In such a fixing apparatus of the present invention, rotation of the swing cam causes the swing lever to swing (reciprocatively rotate), the swinging of the swing lever is transmitted as an intermittent one-way rotation via the one way clutch, and thus a great speed reducing ratio can be obtained.

Even if the positional relationship among the shaft of the cleaning web sheet roller on the rotation transmission portion side and the shafts of the fixing rotation members on the rotation drive portion side changes, which changes the positional relationship between the swing lever and the swing cam, as long as the swing lever is in slide contact with the swing cam, the swing lever swings following the rotation of the swing cam, and a rotation drive force is transmitted from the swing cam to the swing lever, thereby rotating the cleaning web sheet roller.

If the swing lever is separated from the swing cam, the swinging of the swing lever stops, and thus the cleaning web sheet roller stops, which stops taking up and feeding out of the cleaning web sheet.

Alternatively, a fixing apparatus of the present invention includes a first fixing rotation member and a second fixing rotation member that are pressed against each other, a rotation drive portion that rotates at least one of the first and second fixing rotation members, a cleaning web sheet that cleans a circumferential surface of the first or second fixing rotation member, a cleaning web sheet roller that takes up or feeds out the cleaning web sheet, a swing cam that is rotationally driven by the rotation drive portion, a rotation transmission portion that transmits a rotation drive force to the cleaning web sheet roller, a one way clutch that is provided on an input shaft of the rotation transmission portion, a swing lever that is connected to the one way clutch and biased so as to be brought into slide contact with the swing cam, a first frame that rotatably supports the first fixing rotation member, and a second frame that rotatably supports the second fixing rotation member, wherein the second frame is supported displaceably with respect to the first frame, enabling switching between a pressing state and a pressure canceled state of the first and second fixing rotation members, the first frame is provided with the swing cam, the second frame is provided with the swing lever, and the swing lever of the second frame is in slide contact with the swing cam of the first frame irrespective of a displacement position of the second frame, and if the swing cam is rotated by the rotation drive portion, the swing lever that is in slide contact with the swing cam repeatedly swings, the swinging of the swing lever is transmitted as an intermittent one-way rotation to the input shaft of the rotation transmission portion via the one way clutch, and the intermittent rotation is transmitted to the cleaning web sheet roller via the rotation transmission portion.

In such a fixing apparatus of the present invention, by displacing the second frame with respect to the first frame, in other words, by displacing the shaft of the second fixing rotation member with respect to the shaft of the first fixing rotation member, switching between the pressing state and the pressure canceled state of the first and second fixing rotation members can be performed.

In this case, the positional relationship between the swing lever and the swing cam also changes. If the swing lever is in slide contact with the swing cam, the swing lever swings following the rotation of the swing cam, and thus a rotation drive force is transmitted from the swing cam to the swing lever, which enables the cleaning web sheet roller to rotate.

Further, the rotation of the swing cam causes the swing lever to the swing, and the swinging of the swing lever is transmitted as an intermittent one-way rotation via the one way clutch. Thus, a great speed reducing ratio can be obtained.

Further, in the fixing apparatus of the present invention, the second frame may be provided with a separating portion that separates the swing lever from the swing cam.

If the swing lever is separated from the swing cam, the swinging of the swing lever stops, and thus the cleaning web sheet roller stops, which stops taking up and feeding out of the cleaning web sheet.

Moreover, in the fixing apparatus of the present invention, the second frame may be provided with the swing lever, the one way clutch, the rotation transmission portion, and the cleaning web sheet roller.

In this case, the positions of the swing lever, the one way clutch, the rotation transmission portion, and the cleaning web sheet roller with respect to the first fixing rotation member are displaced together with the second fixing rotation member of the second frame.

Further, an image forming apparatus of the present invention includes the above fixing apparatus of the present invention. In such an image forming apparatus, the same operation effects as those of the above fixing apparatus of the present invention are achieved.

In order to achieve the above second object, another fixing apparatus of the present invention includes two fixing rotation members that are pressed against each other, a cleaning web sheet that cleans a circumferential surface of at least one of the fixing rotation members, a cleaning web sheet roller that takes up or feeds out the cleaning web sheet, a rotation drive portion that rotates at least one of the fixing rotation members, a swing cam that is rotationally driven by the rotation drive portion, a rotation transmission portion that transmits a rotation drive force to the cleaning web sheet roller, a one way clutch that is provided on an input shaft of the rotation transmission portion, a swing lever that is connected to the one way clutch and biased so as to be brought into slide contact with the swing cam, a separating portion that separates the swing lever from the swing cam, and a control portion that controls the separating portion, wherein if the swing cam is rotated by the rotation drive portion, the swing lever that is in slide contact with the swing cam repeatedly swings, the swinging of the swing lever is transmitted as an intermittent one-way rotation to the input shaft of the rotation transmission portion via the one way clutch, and the intermittent rotation is transmitted to the cleaning web sheet roller via the rotation transmission portion, and the control portion adjusts, by controlling the separating portion, a time period during which the swing lever is separated from the swing cam or a time period during which the swing lever is in slide contact with the swing cam.

In such another fixing apparatus of the present invention, the rotation of the swing cam causes the swing lever to swing (reciprocatively rotate), and the swinging of the swing lever is transmitted as an intermittent one-way rotation via the one way clutch. Thus, a great speed reducing ratio can be obtained.

Further, even if the positional relationship among the shaft of the cleaning web sheet roller on the rotation transmission portion side and the shafts of the fixing rotation members on the rotation drive portion side changes, which changes the positional relationship between the swing lever and the swing cam, as long as the swing lever is in slide contact with the swing cam, the swing lever swings following the rotation of the swing cam, and a rotation drive force is transmitted from the swing cam to the swing lever, thereby rotating the cleaning web sheet roller.

Moreover, the time period during which the swing lever is separated from the swing cam or the time period during which the swing lever is in slide contact with the swing cam is adjusted by controlling the separating portion, and thus the amount by which the web sheet is taken up or fed out can be adjusted by changing the time period during which the cleaning web sheet roller is continued to rotate.

Further, in the other fixing apparatus of the present invention, the control portion may change the time period during which the swing lever is separated from the swing cam or the time period during which the swing lever is in slide contact with the swing cam according to a rotational speed of the fixing rotation members.

For example, the faster the rotational speed of the fixing rotation members is, the more the control portion may extend the time period during which the swing lever is separated from the swing cam or may shorten the time period during which the swing lever is in slide contact with the swing cam.

Accordingly, irrespective of the rotational speed of the fixing rotation members, the amount by which the web sheet is taken up or fed out can be maintained substantially fixed.

Moreover, the other fixing apparatus of the present invention may have a configuration in which switching between a pressing state and a pressure canceled state of the fixing rotation members is possible, the swing lever is in slide contact with the swing cam irrespective of the pressing state or the pressure canceled state, the swing lever that is in slide contact with the swing cam repeatedly swings if the swing cam is rotated by the rotation drive portion, the swinging of the swing lever is transmitted as an intermittent one-way rotation to the input shaft of the rotation transmission portion via the one way clutch, and the intermittent rotation is transmitted to the cleaning web sheet roller via the rotation transmission portion, and the control portion changes, depending on which of the pressing state and the pressure canceled state is switched to and set, a time period during which the swing lever is separated from the swing cam or a time period during which the swing lever is in slide contact with the swing cam.

In this way, irrespective of the pressing state or the pressure canceled state, the amount by which the web sheet is taken up or fed out can be maintained substantially fixed.

Further, in the other fixing apparatus of the present invention, the control portion may change the time period during which the swing lever is separated from the swing cam or the time period during which the swing lever is in slide contact with the swing cam, in accordance with a wound diameter of the cleaning web sheet roller.

Accordingly, irrespective of the wound diameter of the cleaning web sheet roller, the amount by which the web sheet is taken up or fed out can be maintained substantially fixed.

Moreover, in the other fixing apparatus of the present invention, the time period during which the swing lever is separated from the swing cam may be a time period with which the number of rotations of the swing cam becomes an integer.

Accordingly, the rotation angle of the swing cam when the swing cam is stopped is fixed, and taking up of the web sheet is stopped when the swing lever reaches a fixed angle, which can suppress variations in the amount by which the web sheet is taken up.

Next, the other image forming apparatus of the present invention includes the above other fixing apparatus of the present invention. In such an image forming apparatus, the same operation effects as those of the above fixing apparatus of the present invention are achieved.

DESCRIPTION OF PREFERRED EMBODIMENTS

Below is a detailed description of an embodiment of the present invention, with reference to accompanying drawings.

Figure 1:
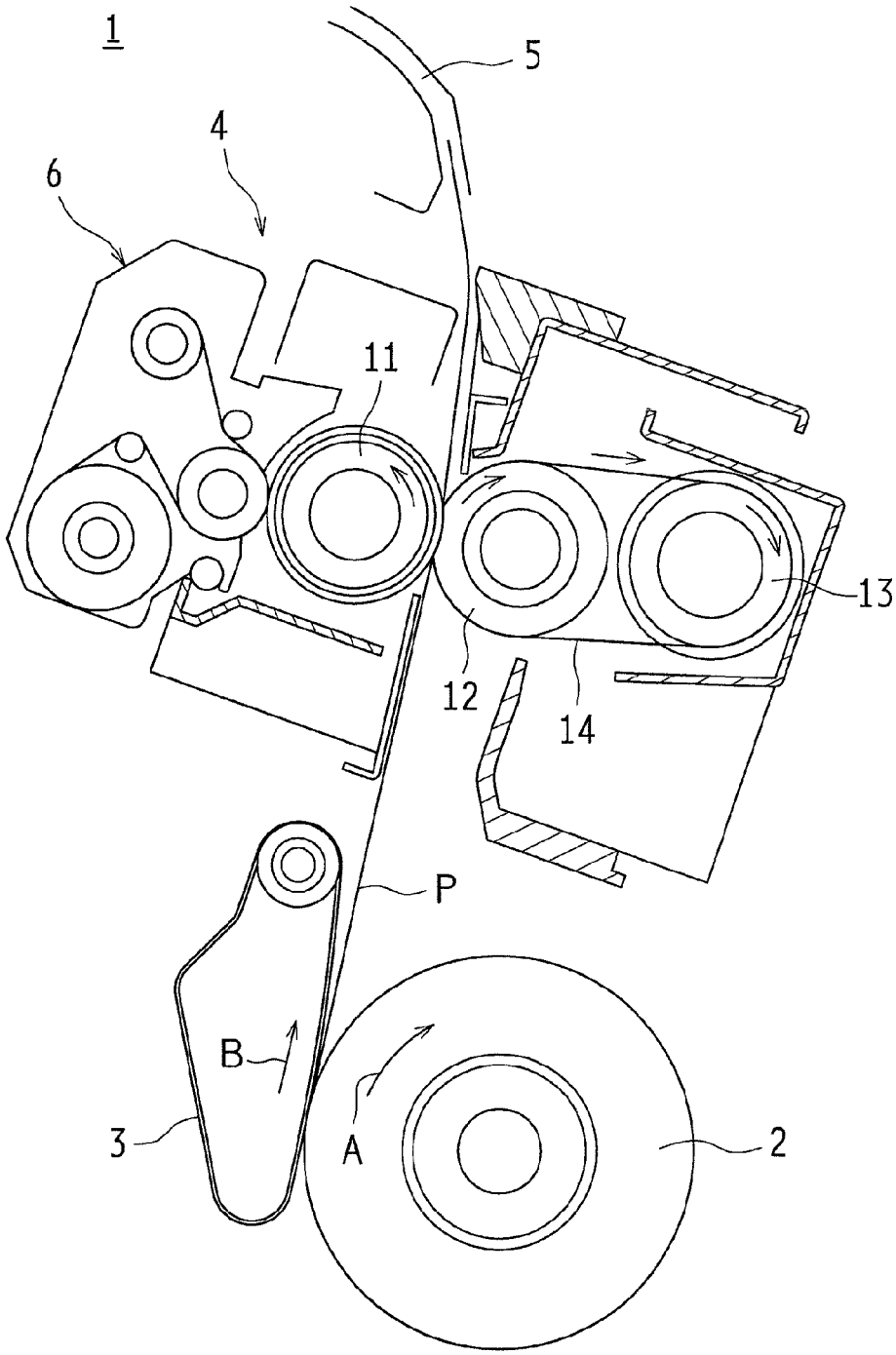
FIG. 1 is an explanatory diagram illustrating a schematic configuration of an image forming apparatus to which an embodiment of a fixing apparatus of the present invention is applied.

FIG. 1 is an explanatory diagram illustrating a schematic configuration of an image forming apparatus to which an embodiment of a fixing apparatus of the present invention is applied, and is a cross-sectional view showing an enlarged principal part of the image forming apparatus to which the embodiment of the fixing apparatus of the present invention is applied. An image forming apparatus 1 is based on an electrophotographic method, and is provided with a photosensitive drum 2, a transfer belt 3, a fixing apparatus 4, and the like. The photosensitive drum 2 has a photosensitive layer on the surface thereof, and is rotationally driven at a fixed rotational speed in the direction of arrow A in FIG. 1. In accordance with the rotation of the photosensitive drum 2, the surface of the photosensitive drum 2 is uniformly charged to a predetermined potential by a charging apparatus (not shown) and is exposed by an exposing apparatus (not shown), an electrostatic latent image is thereby formed on that surface, and the electrostatic latent image on the surface of the photosensitive 2 is developed so as to be a toner image by a development apparatus (not shown).

The transfer belt 3 is driven to revolve in the direction of arrow B in FIG. 1 at the same speed as that of the surface speed of the photosensitive drum 2, and a nip region is formed between the transfer belt 3 and the photosensitive drum 2 by the transfer belt 3 being pressed by the photosensitive drum 2. A recording sheet P transported from therebelow is led into this nip region. The toner image on the surface of the photosensitive drum 2 is transferred onto the recording sheet P while the recording sheet P is being transported in this nip region. A high-voltage transfer bias (a high voltage of the opposite polarity (+) to the charge polarity (−) of the toner) is applied to the transfer belt 3.

The recording sheet P is transported upward, and led into the fixing apparatus 4, where the toner image on the recording sheet P is fixed by being heated and pressed. The recording sheet P is transported further upward through a transport path 5, and is discharged onto a discharge tray (not shown) or the like.

Figure 2:
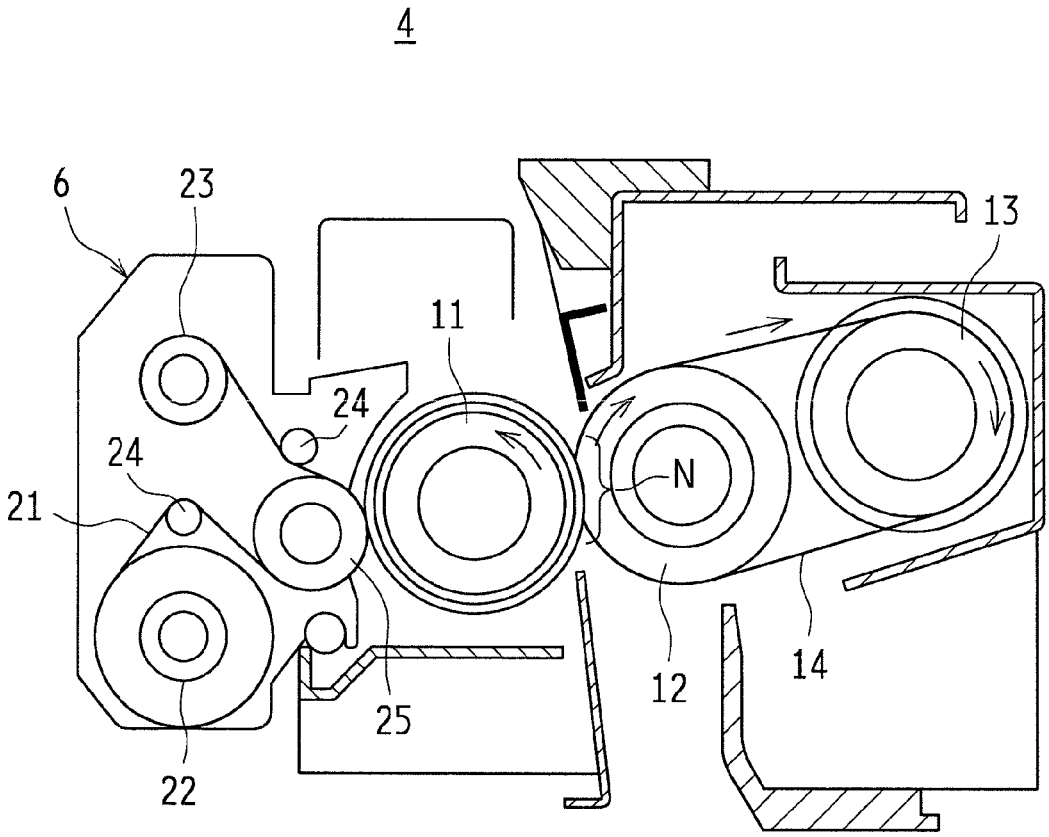
FIG. 2 is a schematic cross-sectional view showing a schematic configuration of the fixing apparatus according to the embodiment of the present invention.

FIG. 2 is a cross-sectional view showing the fixing apparatus 4 according to the present embodiment. As shown in FIG. 2, the fixing apparatus 4 is provided with a pressure roller 11 (second fixing rotation member), a hot roller 12 (first fixing rotation member), a hot assist roller 13, and an endless-shaped fixing belt 14 extended between the hot roller 12 and the hot assist roller 13. The pressure roller 11 and the hot roller 12 are pressed against each other via the fixing belt 14, and a nip region N is formed between the fixing belt 14 and the pressure roller 11.

The pressure roller 11 is a roller having a three-layer structure in which an elastic layer is provided on the outer surface of a hollow shaft, and a releasing layer is formed on the outer surface of the elastic layer. A heater lamp (halogen lamp) serving as a heat source that heats the pressure roller 11 is provided inside the pressure roller 11 (inside the hollow shaft).

The hot roller 12 is a roller in which an elastic layer is provided on the outer surface of a hollow shaft, and the elastic layer is sufficiently thick.

The fixing belt 14 is an endless belt made of a material having favorable heat conduction, and has a releasing layer on its outer circumferential surface.

The hot assist roller 13 is a roller in which a surface layer is provided on the outer surface of a hollow shaft, and a heater lamp (halogen lamp) serving as a heat source that heats the hot assist roller 13 is provided inside the hot assist roller 13 (inside the hollow shaft).

Here, since the elastic layer of the hot roller 12 is sufficiently thick, the elastic layer of the hot roller 12 is greatly dented if the pressure roller 11 and the hot roller 12 are pressed against each other via the fixing belt 14, thereby forming the wide nip region N between the fixing belt 14 and the pressure roller 11. When the rollers 11, 12, and 13 rotate in the respective directions of the arrows shown in FIG. 2, the fixing belt 14 is caused to revolve via the nip region N while being heated by the hot assist roller 13. In this state, if a recording sheet is transported through the nip region N, the recording sheet is heated and pressed by the fixing belt 14 and the pressure roller 11, thereby fixing a toner image on the recording sheet.

On the other hand, the fixing apparatus 4 is provided with a cleaning unit 6 that cleans the circumferential surface of the pressure roller 11. The cleaning unit 6 is provided with a feed-out roller 22 (cleaning web sheet roller) having a web sheet 21 (cleaning web sheet) wound therearound, the web sheet 21 being made of a thin fabric (having a thickness of about 100 μm) soaked with an oil (silicone oil), a take-up roller 23 to which the end of the web sheet 21 is connected, a plurality of tension rollers 24 on which the web sheet 21 that is fed out from the feed-out roller 22 and taken up by the take-up roller 23 (cleaning web sheet roller) is extended, and a pressing roller 25 that presses the web sheet 21 against the pressure roller 11 between the feed-out roller 22 and the take-up roller 23. The web sheet 21 is pressed against the surface of the pressure roller 11 by the pressing roller 25, which causes the web sheet 21 to wipe off and remove adhering toner that has adhered to the surface of the pressure roller 11.

The web sheet 21 is taken up little by little by the take-up roller 23 and is fed out little by little from the feed-out roller 22, according to the number of recording sheets to be printed, the print processing time period, or the amount of toner consumption. Accordingly, a portion of the web sheet 21 in the nip region between the pressing roller 25 and the pressure roller 11 is renewed, thereby maintaining the cleaning capacity provided by the web sheet 21.

In the fixing apparatus 4 as described above, it is preferable to use a drive source of the pressure roller 11 and the hot roller 12 for fixing as a drive source for rotating the feed-out roller 22 and the take-up roller 23 for the web sheet 21. In this case, the rotational speed of the rollers 22 and 23 for the web sheet 21 is very slow, compared with the rotational speed of the rollers 11 and 12 for fixing, and thus a great speed reduction ratio will be necessary.

As described in detail later, the distance between the shafts of the rollers 11 and 12 for fixing is changed in order to switch between a pressing state in which the rollers 11 and 12 for fixing are pressed against each other and a pressure canceled state in which pressure between the rollers 11 and 12 for fixing is canceled, and set the switched state. In accordance with this change in the distance between the shafts, the positional relationship among the shaft of the hot roller 12 and the shafts of the rollers 22 and 23 for the web sheet 21 also changes. However, it is necessary to rotate the rollers 11, 12, 22, and 23 together even if that positional relationship changes. For example, although the rollers 11 and 12 for fixing are set to be in the pressure canceled state when performing printing on a thick envelope or the like, it is preferable to rotate not only the rollers 11 and 12 for fixing, but also the rollers 22 and 23 for the web sheet 21 in order to clean the circumferential surface of the pressure roller 11 at this time as well.

In view of this, in the present embodiment, the rollers 11 and 12 for fixing of the fixing apparatus 4 are rotationally driven by a drive source (referred to as rotation drive portion in the present invention) of the image forming apparatus 1, and by using an eccentric cam 36, a swing lever 37, and a one way clutch 41 that will be described later, the rotation of the rollers 11 and 12 for fixing is greatly slowed down and transmitted to the rollers 22 and 23 for the web sheet 21, and the rollers 11 and 12 for fixing and the rollers 22 and 23 for the web sheet 21 are together rotated irrespective of the change in the distance between the shafts of the rollers 11 and 12 for fixing.

In the case where the rollers 11 and 12 for fixing and the rollers 22 and 23 for the web sheet 21 are caused to operate in conjunction with each other, if the rotational speed of the rollers 11 and 12 for fixing is changed, the rotational speed of the rollers 22 and 23 for the web sheet 21 also changes. For example, the process speed may be changed depending on whether to print a color image or a monochrome image, and along with this, the rotational speed of the rollers 11 and 12 for fixing may be changed. Moreover, if the distance between the shafts of the rollers 11 and 12 for fixing changes, the positional relationship among the eccentric cam 36, the swing lever 37, and the like changes, which also changes the rotational speed of the rollers 22 and 23 for the web sheet 21.

Then, if the rotational speed of the rollers 22 and 23 for the web sheet 21 changes in this way, the accurate amount by which the web sheet 21 is taken up will no longer be maintained. Accordingly, the rotational speed of the rollers 22 and 23 for the web sheet 21 is controlled by enabling the switching between the operating and stopped states of the rollers 22 and 23 for the web sheet 21.

The following is a detailed description of a rotation drive mechanism using the eccentric cam 36, the swing lever 37, and the one way clutch 41 as described above.

Figure 3:
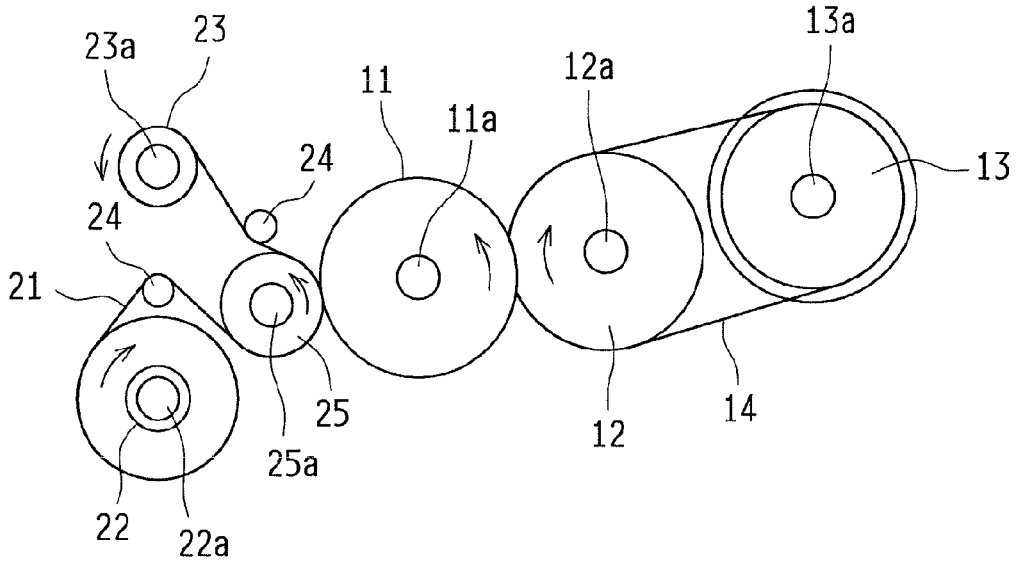
FIG. 3 is a lateral view schematically showing the positional relationship between shafts of rollers in the fixing apparatus according to the embodiment of the present invention.

FIG. 3 is a lateral view schematically showing the positional relationship among a shaft 11*a* of the pressure roller 11, a shaft 12*a* of the hot roller 12, a shaft 13*a* of the hot assist roller 13, a shaft 22*a* of the feed-out roller 22, a shaft 23*a* of the take-up roller 23, the tension rollers 24, and a shaft 25*a* of the pressing roller 25.

Figure 4:
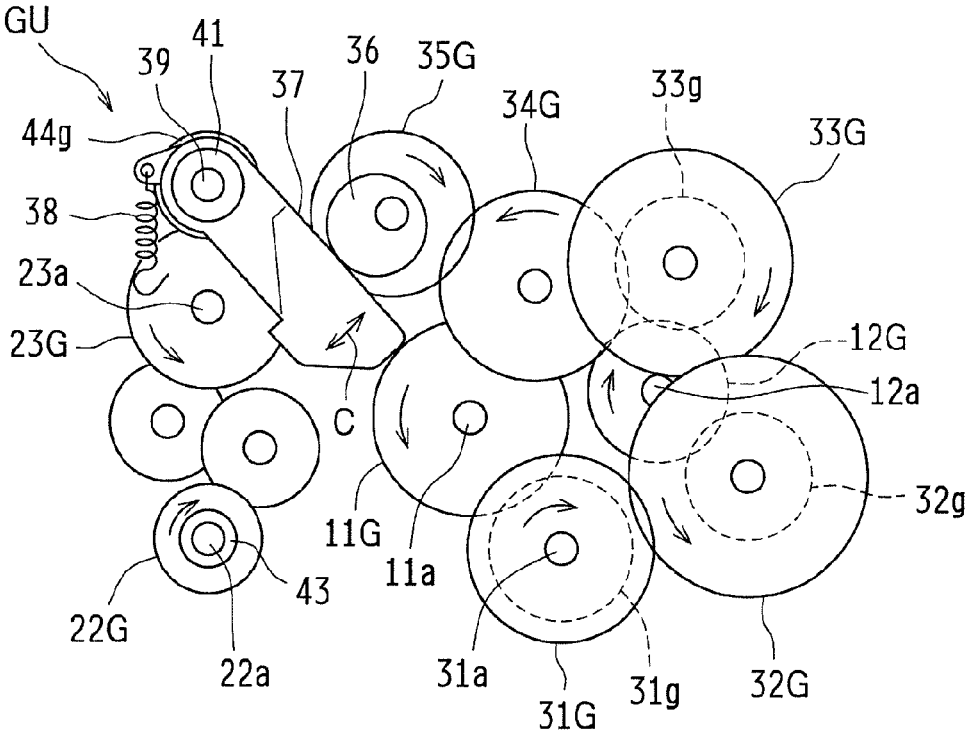
FIG. 4 is a lateral view schematically showing gears of shafts of the rollers and a group of other gears in the fixing apparatus according to the embodiment of the present invention.

FIG. 4 is a lateral view schematically showing gears 11G, 12G, 22G, and 23G that are respectively fixed to the shaft 11*a* of the pressure roller 11, the shaft 12*a* of the hot roller 12, the shaft 22*a* of the feed-out roller 22, and the shaft 23*a* of the take-up roller 23, and other gears that transmit rotation to the gears 11G, 12G, 22G, and 23G, and the like.

Here, the drive source of the rollers 11 and 12 for fixing and the rollers 22 and 23 for the web sheet 21 of the fixing apparatus 4 is provided on the image forming apparatus 1 side, and when the fixing apparatus 4 is removably attached to the image forming apparatus 1, a gear of an output shaft (not shown) that is rotationally driven on the image forming apparatus 1 side meshes with an input gear 31G of an input shaft of the fixing apparatus 4, thereby rotationally driving the input gear 31G.

If the input gear 31G is rotationally driven in the arrow direction (clockwise direction viewed from the side shown in FIG. 4), a small gear 31*g* fixed to the input gear 31G is rotationally driven, and the gear 11G of the pressure roller 11 that meshes with the small gear 31*g* rotates in the arrow direction (counter-clockwise direction viewed from the side shown in FIG. 4), thus causing the pressure roller 11 to rotate in the same direction as that of the gear 11G.

Further, if the input gear 31G is rotationally driven in the arrow direction (clockwise direction viewed from the side shown in FIG. 4), a gear 32G that meshes with the input gear 31G and a small gear 32*g* fixed to the gear 32G rotate, and the gear 12G of the hot roller 12 that meshes with the small gear 32*g* rotates in the arrow direction (clockwise direction viewed from the side shown in FIG. 4). A one way clutch (not shown) is interposed between the gear 12G and the shaft 12*a* of the hot roller 12. As long as the rotation drive force of the pressure roller 11 is transmitted to the hot roller 12 via the fixing belt 14, and the hot roller 12 idly rotates, rotation torque is not transmitted from the gear 12G to the shaft 12*a* of the hot roller 12 via the one way clutch. Only when the rotational speed of the hot roller 12 decreases due to the slip of the fixing belt 14 or the hot roller 12, the one way clutch is locked, and rotation torque is transmitted from the gear 12G to the shaft 12*a* of the hot roller 12 via the one way clutch, thereby preventing the rotational delay of the hot roller 12.

The speed of the circumferential surface of the pressure roller 11 and the speed of the circumferential surface of the fixing belt 14 are set substantially the same, and a recording sheet is transported upward through the nip region N between the pressure roller 11 and the fixing belt 14.

Moreover, a gear 33G that meshes with the gear 32G and a small gear 33*g* fixed to the gear 33G rotate, a gear 34G that meshes with the small gear 33*g* rotates, a cam gear 35G that meshes with the gear 34G rotates, and thus the eccentric cam (swing cam) 36 fixed to the cam gear 35G rotates in the arrow direction (clockwise direction viewed from the side shown in FIG. 4).

The swing lever 37 is biased by a spring 38 in the counter-clockwise direction (counter-clockwise direction viewed from the side shown in FIG. 4) about a shaft 39, and is in contact with the circumferential surface of the eccentric cam 36. The first one way clutch 41 that transmits only the rotation of the swing lever 37 in the clockwise direction (clockwise direction viewed from the side shown in FIG. 4) to the shaft 39 is interposed between the swing lever 37 and the shaft 39.

Since the swing lever 37 is in contact with the eccentric cam 36 by being biased by the spring 38, the swing lever 37 swings (reciprocatively rotates) as shown by arrow C when the eccentric cam 36 rotates. Following the swinging, only the rotation of the swing lever 37 in the clockwise direction is transmitted to the shaft 39 via the first one way clutch 41, and the shaft 39 intermittently rotates in the clockwise direction. For example, every time the eccentric cam 36 makes one full rotation, the shaft 39 rotates about 7.5° to 15°. A great speed reducing ratio can be obtained by the combination of the eccentric cam 36 and the swing lever 37.

The rotation of the shaft 39 is further slowed down by a rotation transmission unit GU, and is transmitted to the gear 23G, thus causing the take-up roller 23 to rotate at a low speed in the arrow direction (counter-clockwise direction viewed from the side shown in FIG. 4). Accordingly, the web sheet 21 is taken up little by little by the take-up roller 23, and thereby fed out little by little from the feed-out roller 22, thus causing the feed-out roller 22 to idly rotate.

Figure 5:
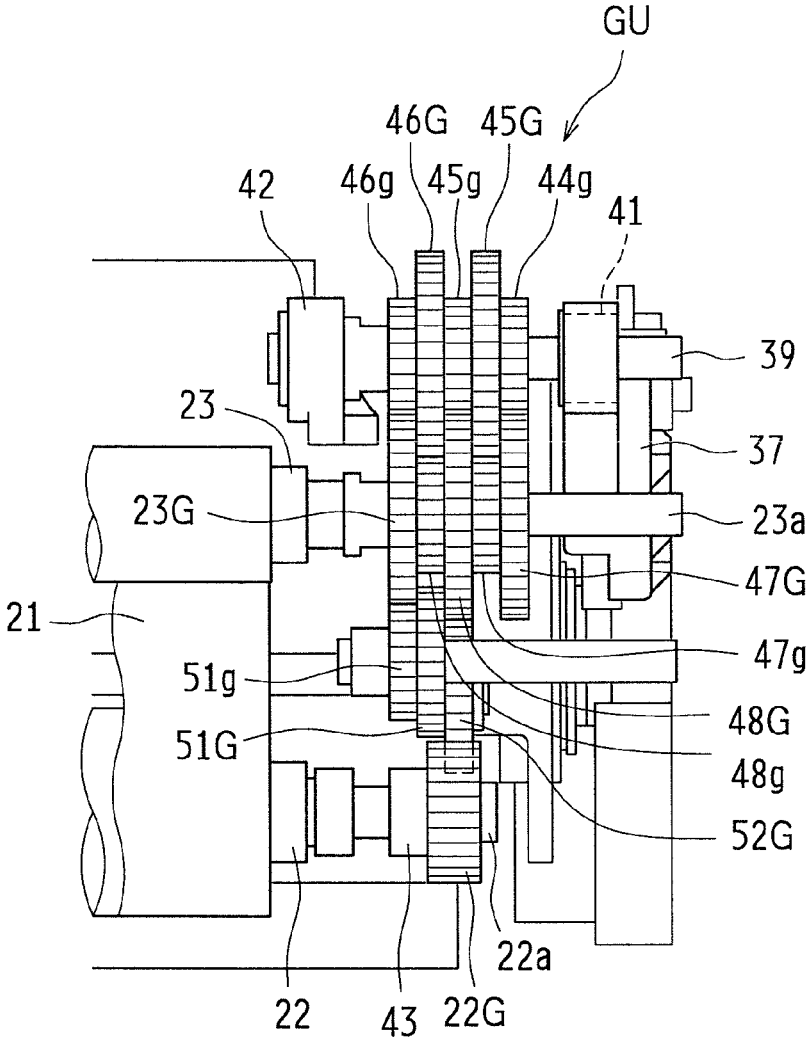
FIG. 5 is a front view showing a schematic configuration of a rotation transmission unit in the fixing apparatus according to the embodiment of the present invention.

FIG. 5 is a front view schematically showing a schematic configuration of the rotation transmission unit GU. The rotation transmission unit GU uses the shaft 39 as a rotation input shaft. The first one way clutch 41 is provided at one end of the shaft 39, and the swing lever 37 is connected to the first one way clutch 41. Specifically, the first one way clutch 41 is interposed between the swing lever 37 and the end of the shaft 39. Further, the other end of the shaft 39 is rotatably supported by a second one way clutch 42, and the second one way clutch 42 is fixed to a second unit frame of a second frame 64 described later.

As described above, although only the rotation of the swing lever 37 in the clockwise direction is transmitted to the shaft 39 via the first one way clutch 41, the second one way clutch 42 becomes free at this time, and the shaft 39 rotates in the clockwise direction. Although the first one way clutch 41 becomes free when the swing lever 37 rotates in the counter-clockwise direction and returns, the slight rotation torque in the counter-clockwise direction may be transmitted to the shaft 39 via the first one way clutch 41, which may cause the shaft 39 to rotate in the counter-clockwise direction, and thus rotation of the shaft 29 in the counter-clockwise direction is prohibited by the second one way clutch 42. Accordingly, a combination of the first and second one way clutches 41 and 42 causes the shaft 39 to reliably rotate intermittently in the clockwise direction.

The shaft 39 is provided with five gears 44*g*, 45G, 45*g*, 46G, and 46*g*. The small gear 44*g* is fixed to the shaft 39, and rotates together with the shaft 39. The gear 45G and the small gear 45*g* are fixed to each other, and are supported so as to be rotatable about the shaft 39. The gear 46G and the small gear 46*g* are also fixed to each other, and are supported so as to be rotatable about the shaft 39.

The shaft 23*a* of the take-up roller 23 is also provided with five gears 47G, 47*g*, 48G, 48*g*, and 23G. The gear 23G is fixed to the shaft 23*a* of the take-up roller 23, and rotates together with the shaft 23*a* of the take-up roller 23. The gear 47G and the small gear 47*g* are fixed to each other, and supported so as to be rotatable about the shaft 23*a*. The gear 48G and the small gear 48*g* are also fixed to each other, and supported so as to be rotatable about the shaft 23*a*.

The gears 44*g*, 45G, 45*g*, 46G, and 46*g* of the shaft 39 respectively mesh with the gears 47G, 47*g*, 48G, 48*g*, and 23G of the shaft 23*a*. If the shaft 39 rotates in the clockwise direction (clockwise direction viewed from the side shown in FIG. 4), the small gear 44*g* fixed to the shaft 39 rotates, and this rotation is slowed down by being transmitted as follows: the gear 47G and the small gear 47*g*→the gear 45G and the small gear 45*g*→the gear 48G and the small gear 48*g*→the gear 46G and the small gear 46*g*→the gear 23G. The gear 23G and the shaft 23*a* fixed to the gear 23G rotate at a low speed, thus causing the take-up roller 23 also to rotate at a low speed in the arrow direction in FIG. 3 (counter-clockwise direction viewed from the side shown in FIG. 3).

Moreover, if the gear 23G rotates, a small gear 51*g* that meshes with the gear 23G and a gear 51G that is fixed to the small gear 51*g* rotate. Then, a small gear (not shown) that meshes with the gear 51G and a gear 52G that is fixed to that small gear rotate, and thus the gear 22G that meshes with the gear 52G rotates. The gear 22G rotates together with a third one way clutch 43 in the arrow direction in FIG. 4 (clockwise direction viewed from the side shown in FIG. 4).

The third one way clutch 43 is interposed between the gear 22G and the shaft 22*a* of the feed-out roller 22, and freely rotates about the shaft 22*a* of the feed-out roller 22 in the arrow direction in FIG. 4 (clockwise direction viewed from the side shown in FIG. 4). Accordingly, even if the gear 22G and the third one way clutch 43 rotate in the arrow direction in FIG. 4 (clockwise direction viewed from the side shown in FIG. 4), rotation torque in the arrow direction in FIG. 4 (clockwise direction viewed from the side shown in FIG. 4) is not transmitted from the gear 22G to the shaft 22*a* of the feed-out roller 22 via the third one way clutch 43, and the feed-out roller 22 is not rotationally driven either. Accordingly, the web sheet 21 is fed out from the feed-out roller 22 following the web sheet 21 being taken up by the take-up roller 23, which causes the feed-out roller 22 to just rotate idly.

When the wound diameter of the web sheet 21 on the take-up roller 23 increases, and the wound diameter of the web sheet 21 on the feed-out roller 22 decreases, the take-up speed and the feed-out speed increases, and the idle rotation speed of the feed-out roller 22 increases, and thus the rotational speed is accelerated between the shaft 23*a* of the take-up roller 23 and the third one way clutch 43. Thus, even if the take-up speed and the feed-out speed increase, the third one way clutch 43 rotates faster, which maintains the idle rotation of the feed-out roller 22.

The third one way clutch 43 is provided in order to prevent the web sheet 21 from being excessively fed out from the feed-out roller 22, by being locked when the web sheet 21 is caught by the pressure roller 11, and the feed-out roller 22 idly rotates faster than the third one way clutch 43, for example.

Figure 6A:
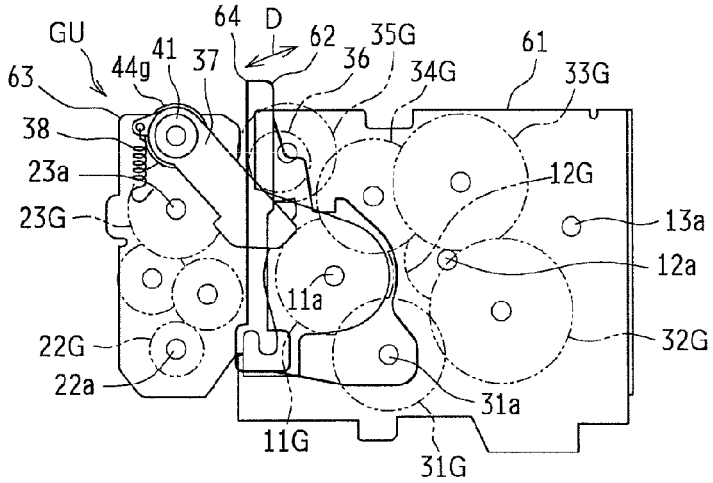
FIG. 6A is a lateral view schematically showing a schematic configuration of a first frame, a first unit frame, and a second unit frame in a pressing state where a pressure roller and a fixing belt are pressed against each other in the fixing apparatus according to the embodiment of the present invention.

FIG. 6A is a lateral view schematically showing the schematic configuration of frames provided in the fixing apparatus 4. As shown in FIG. 6A, the fixing apparatus 4 has a first frame 61 and the second frame 64. Further, the second frame 64 is constituted by a first unit frame 62 and a second unit frame 63.

In the first frame 61, the shaft 12*a* of the hot roller 12 and the shaft 13*a* of the hot assist roller 13 are supported, and the gears 31G, 31*g* (shown in FIG. 4), 32G, 32*g* (shown in FIG. 4), 33G, 33*g* (shown in FIG. 4), 34G, and 35G are rotatably supported.

In the first unit frame 62 of the second frame 64, the shaft 11*a* of the pressure roller 11 is supported. The first unit frame 62 is coupled to the first frame 61 at the area of a shaft 31*a* of the input gear 31G, and can reciprocatively rotate about the shaft 31*a* of the input gear 31G as shown by arrow D in FIG. 6A. The reciprocative rotation angle thereof is about 3.5°.

The second unit frame 63 of the second frame 64 is detachably fixed to the left wall part of the first unit frame 62. The rotation transmission unit GU is supported in the second unit frame 63. Specifically, the second unit frame 63 of the second frame 64 is provided with the swing lever 37, the rotation transmission unit GU, and the rollers 22 and 23 for the web sheet 21.

Here, normally, as shown in FIG. 6A, the first unit frame 62 of the second frame 64 is biased by a spring (not shown) in the clockwise direction (clockwise direction viewed from the side shown in FIG. 6A) about the shaft 31*a* of the input gear 31G. Thus, the shaft 11*a* of the pressure roller 11 on the first unit frame 62 side comes close to the shaft 12*a* of the hot roller 12 on the first frame 61 side, and the pressure roller 11 and the hot roller 12 are pressed against each other via the fixing belt 14, thereby forming the nip region N between the fixing belt 14 and the pressure roller 11. This state is the pressing state.

This pressing state is set when a recording sheet having a normal thickness is sandwiched in the nip region N between the fixing belt 14 and the pressure roller 11, so as to fix a toner image on the recording sheet.

Figure 6B:
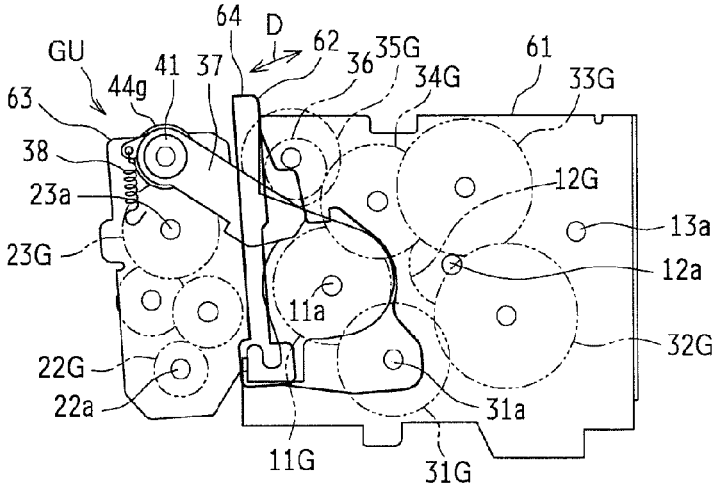
FIG. 6B is a lateral view schematically showing a schematic configuration of the first frame, the first unit frame, and the second unit frame in a pressure canceled state where the pressure roller is in slight contact with the fixing belt in the fixing apparatus according to the embodiment of the present invention.

Further, as shown in FIG. 6B, if the first unit frame 62 of the second frame 64 is rotated in the counter-clockwise direction (counter-clockwise direction viewed from the side shown in FIG. 6A) about the shaft 31*a* of the input gear 31G, opposing the biasing force of the spring, the shaft 11*a* of the pressure roller 11 on the first unit frame 62 side separates from the shaft 12*a* of the hot roller 12 on the first frame 61 side, thereby causing the pressure roller 11 and the fixing belt 14 to be in slight contact with each other. This state is the pressure canceled state.

In the pressure canceled state, not only the shaft 11*a* of the pressure roller 11 separates from the shaft 12*a* of the hot roller 12, the position of the shaft 23*a* of the take-up roller 23 with respect to the shaft 12*a* of the hot roller 12 is also displaced.

This pressure canceled state is set when printing a thick envelope or the like. In the pressure canceled state, when a thick envelope or the like is sandwiched between the fixing belt 14 and the pressure roller 11, a toner image on the envelope can be favorably fixed by applying appropriate pressure and heat to the envelope.

Further, the pressure canceled state is also set when not performing printing and fixing. In the pressing state, the pressure roller 11 and the hot roller 12 are pressed against each other via the fixing belt 14, which causes the elastic layer of the hot roller 12 to be greatly dented. Thus, if the hot roller 12 is left as it is for a long time, the hot roller 12 deforms, which causes a fixing defect. Accordingly, when not performing printing and fixing, the pressure canceled state is set, thereby preventing a dent from being generated in the elastic layer of the hot roller 12.

As is clear from FIGS. 6A and 6B, to switch between the pressing state and the pressure canceled state, the second frame 64 (the first unit frame 62) only rotates about the shaft of the input gear 31G. Thus, the distance between the shafts of the input gear 31G and the gear 11G of the pressure roller 11 does not change due to this switching, thus maintaining the meshed state of the input gear 31G and the gear 11G. Also, the distance between the shafts of the input gear 31G and the gear 32G does not change either, thus maintaining the meshed state of the input gear 31G and the gear 32G. Accordingly, regardless of whether the pressing state or the pressure canceled state is set, the pressure roller 11 and the hot roller 12 can be rotated, and fixing processing can be performed on a recording sheet or an envelope.

It should be noted that if the positional relationship between the shaft 12*a* of the hot roller 12 and the shaft 23*a* of the take-up roller 23 changes due to the switching between the pressing state and the pressure canceled state, the positional relationship between the eccentric cam 36 and the swing lever 37 also changes.

However, even if either the pressing state or the pressure canceled state is set, the swing lever 37 is biased by the spring 38 in the counter-clockwise direction about the shaft 39, and thereby brought into contact with the circumferential surface of the eccentric cam 36. Accordingly, regardless of whether the pressing state or the pressure canceled state is set, if the eccentric cam 36 rotates following the rotation of the pressure roller 11 and the hot roller 12, the swing lever 37 swings, and the take-up roller 23 and the feed-out roller 22 rotate at a low speed, which enables cleaning of the surface of the pressure roller 11 using the web sheet 21.

Figure 6C:
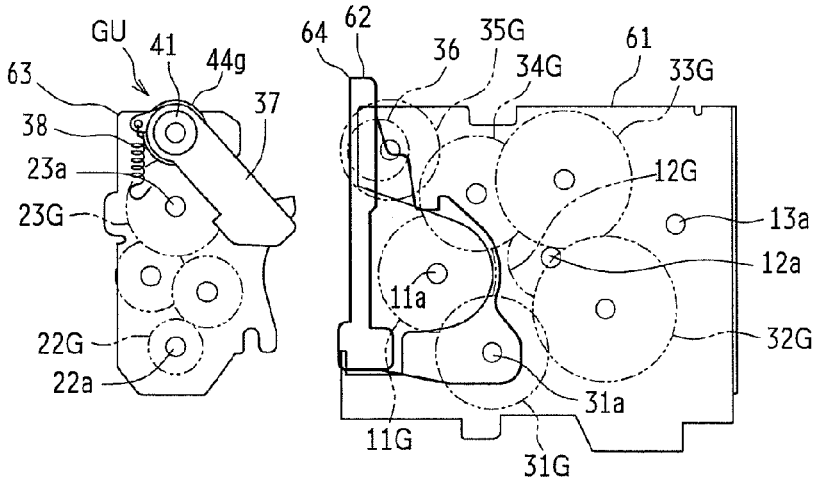
FIG. 6C is a lateral view schematically showing a schematic configuration of the first frame, the first unit frame, and the second unit frame when the second unit frame has been detached from the first unit frame in the fixing apparatus according to the embodiment of the present invention.

Moreover, as shown in FIG. 6C, the second unit frame 63 of the second frame 64 is removably attached to the left wall part of the first unit frame 62. Accordingly, it is possible to exchange the second unit frame 63.

Figure 7A:
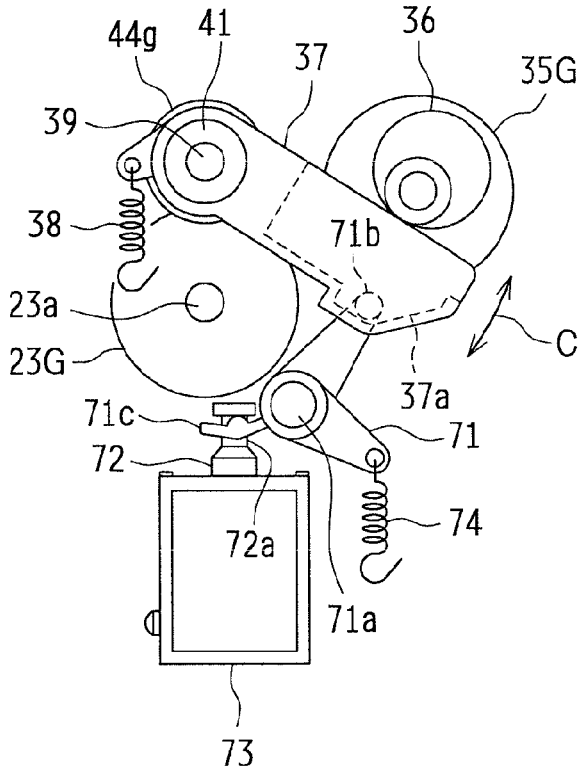
FIG. 7A is an explanatory diagram illustrating an operation of an eccentric cam and a swing lever in the pressing state where the pressure roller and the fixing belt are pressed against each other in the fixing apparatus according to the embodiment of the present invention.

The following is a detailed description of the operation of the eccentric cam 36 and the swing lever 37. FIG. 7A is a lateral view schematically showing the peripheral mechanism of the eccentric ram 36 and the swing lever 37 in the pressing state in which the pressure roller 11 and the hot roller 12 are pressed against each other via the fixing belt 14, as shown in FIG. 6A.

As shown in FIG. 7A, the first one way clutch 41 is interposed between the swing lever 37 and the shaft 39, and the swing lever 37 is biased by the spring 38 about the shaft 39 in the counter-clockwise direction (counter-clockwise direction viewed from the side shown in FIG. 7A), so as to be in contact with the circumferential surface of the eccentric cam 36. If the eccentric cam 36 rotates, the swing lever 37 swings (reciprocatively rotates) as shown by arrow C, and only the rotation of the swing lever 37 in the clockwise direction (clockwise direction viewed from the side shown in FIG. 7A) is transmitted to the shaft 39 via the first one way clutch 41. Thus, the shaft 39 rotates intermittently in the clockwise direction.

An L-shaped control lever 71 is axially and rotatably supported by a shaft 71*a* in the second unit frame 63 of the second frame 64 (see FIG. 6A). A pin 71*b* is provided protruding at an end of the control lever 71, and fitted inside a frame portion 37*a* on the right side of the swing lever 37 (the opposite side to a side where the first one way clutch 41 is connected). The pin 71*b* of the control lever 71 catches the frame portion 37*a*, and accordingly the upward movement of the swing lever 37 is restricted by the pin 71*b* of the control lever 71.

A fork portion 71*c* is provided in the center of the control lever 71, and if the tip of a plunger 72 is viewed from above, a constricted portion 72*a* of the plunger 72 is sandwiched inside the fork portion 71*c*. The plunger 72 is inserted in an opening in the center of a solenoid 73. When the solenoid 73 is in a de-energized state, the plunger 72 is biased upward by a spring 74 so as to protrude from the solenoid 73, whereas when the solenoid 73 is in an energized state, the plunger 72 is pulled inside the solenoid 73, opposing the biasing force of the spring 74.

If the solenoid 73 is energized, thereby pulling the plunger 72 inside the solenoid 73, the fork portion 71*c* of the control lever 71 that sandwiches the constricted portion 72*a* of the plunger 72 is pulled down. Consequently, the control lever 71 rotates counter-clockwise about the shaft 71*a*, and the pin 71*b* of the control lever 71 rises. Accordingly, the swing lever 37 can rotate in the counter-clockwise direction until the frame portion 37*a* on the right side of the swing lever 37 bumps against the pin 71*b*, which enables the swing lever 37 to swing.

Figure 7B:
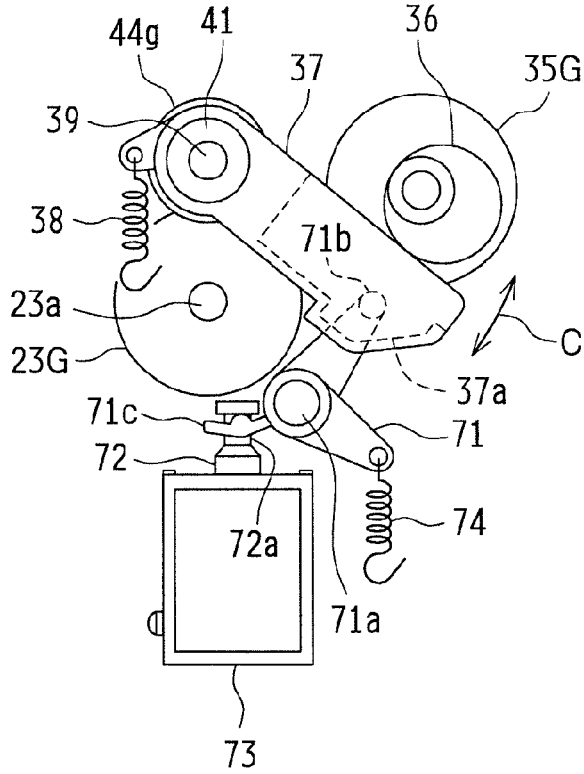
FIG. 7B is an explanatory diagram illustrating an operation of the eccentric cam and the swing lever in the pressing state where the pressure roller and the fixing belt are pressed against each other in the fixing apparatus according to the embodiment of the present invention.
Figure 7C:
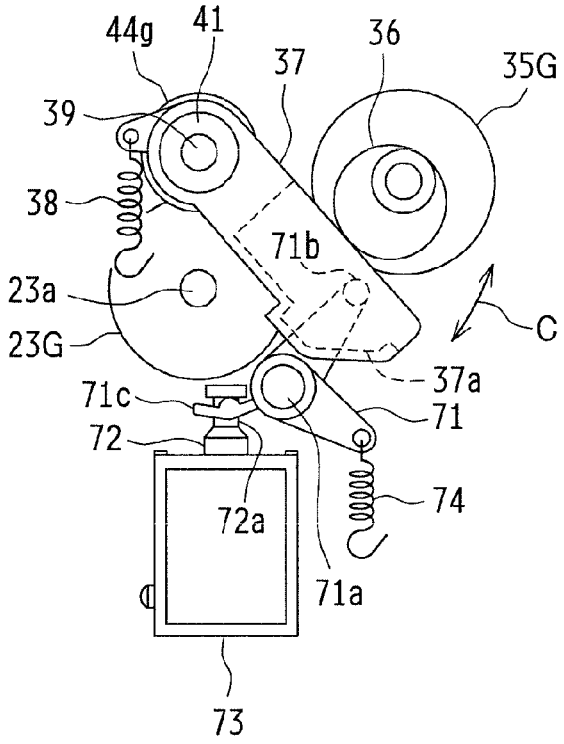
FIG. 7C is an explanatory diagram illustrating an operation of the eccentric cam and the swing lever in the pressing state where the pressure roller and the fixing belt are pressed against each other in the fixing apparatus according to the embodiment of the present invention.
Figure 7D:
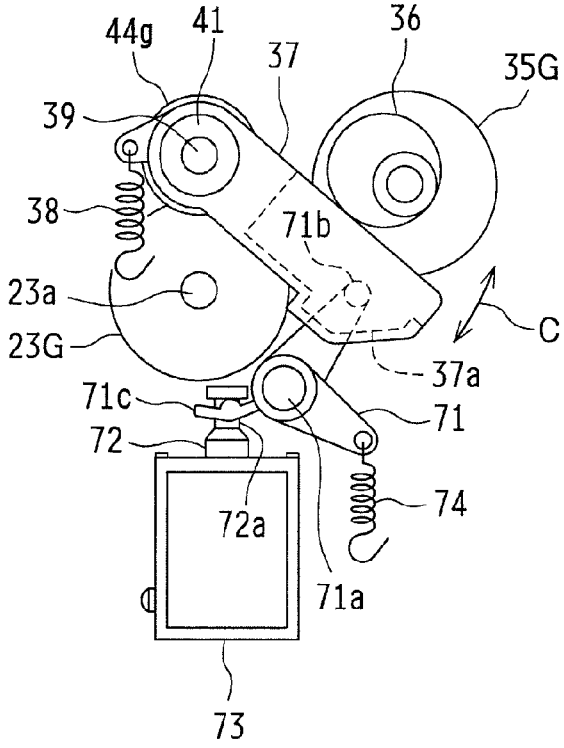
FIG. 7D is an explanatory diagram illustrating an operation of the eccentric cam and the swing lever in the pressing state where the pressure roller and the fixing belt are pressed against each other in the fixing apparatus according to the embodiment of the present invention.

At this time, the swing lever 37 rotates counter-clockwise due to the biasing force of the spring 38, which brings the swing lever 37 to come into contact with the circumferential surface of the eccentric cam 36. Then, as shown in FIGS. 7A and 7B, if the cam gear 35G and the eccentric cam 36 rotate, the swing lever 37 follows the circumferential surface of the eccentric cam 36 so as to swing up and down.

Figure 8A:
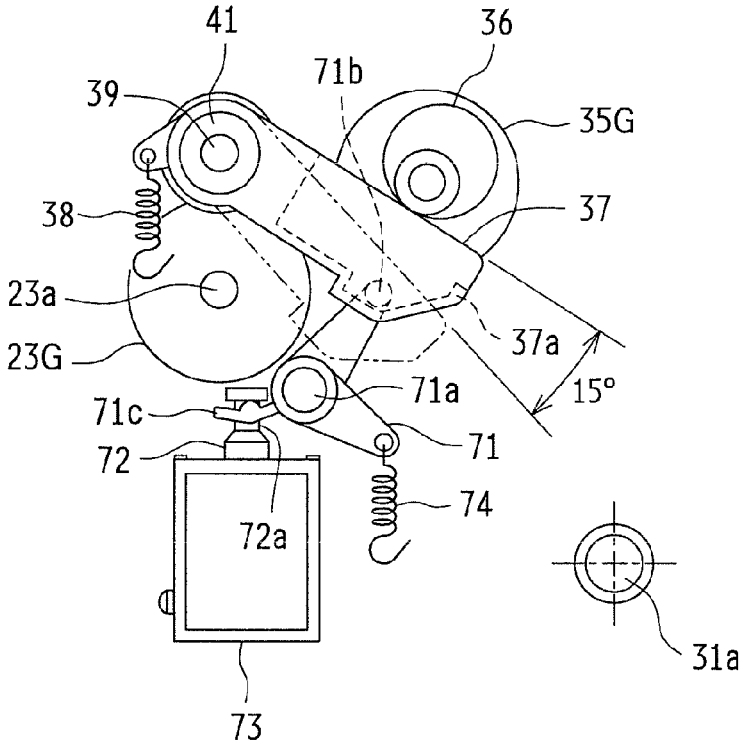
FIG. 8A is an explanatory diagram illustrating the swing angle of the swing lever in the pressing state where the pressure roller and the fixing belt are pressed against each other in the fixing apparatus according to the embodiment of the present invention.

In the pressing state in which the pressure roller 11 and the hot roller 12 are pressed against each other via the fixing belt 14 as shown in FIG. 6A, the pin 71*b* of the control lever 71 comes close to the eccentric cam 36 as shown in FIG. 8A, which widens the swing range of the swing lever 37 that is restricted by the pin 71*b*. For example, in the present embodiment, the swing angle of the swing lever 37 is increased to 15°.

Figure 8B:
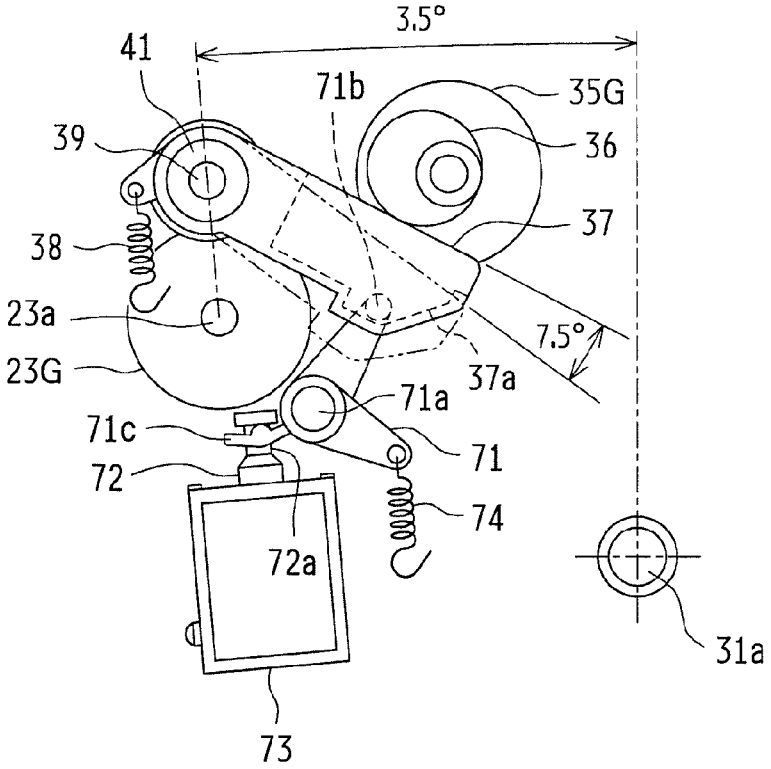
FIG. 8B is an explanatory diagram illustrating the swing angle of the swing lever in the pressure canceled state where the pressure roller is in slight contact with the fixing belt in the fixing apparatus according to the embodiment of the present invention.

In the pressure canceled state as shown in FIG. 6B, as shown in FIG. 8B, the pin 71*b* of the control lever 71 is separated from the eccentric cam 36, which narrows the swing range of the swing lever 37 that is restricted by the pin 71*b*. For example, the swing angle of the swing lever 37 is decreased to 7.5° in the present embodiment.

In both the pressing state and the pressure canceled state, if the cam gear 35G and the eccentric cam 36 rotate, the swing lever 37 follows the circumferential surface of the eccentric cam 36 so as to swing up and down, and thus the web sheet 21 is taken up by the take-up roller 23, and fed out from the feed-out roller.

Further, in the pressing state, the swing lever 37 swings 15° due to one full rotation of the eccentric cam 36, whereas in the pressure canceled state, the swing lever 37 swings 7.5° due to one full rotation of the eccentric cam 36. Thus, the rotational speed of the take-up roller 23 changes depending on whether the pressing state or the pressure canceled state is set.

Figure 9:
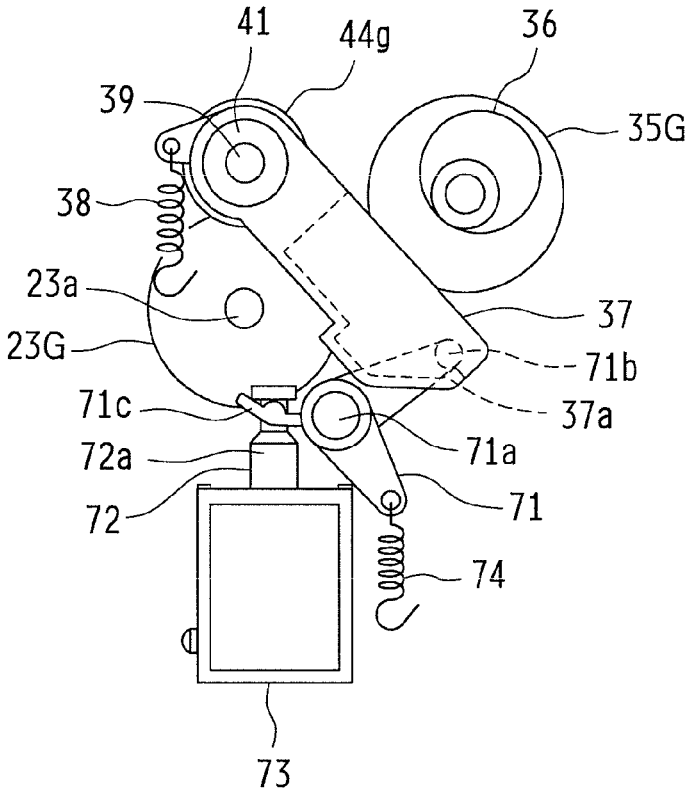
FIG. 9 is an explanatory diagram illustrating the state where the swing lever is separated from the eccentric cam in the fixing apparatus according to the embodiment of the present invention.

As shown in FIG. 9, if the solenoid 73 is de-energized so that the plunger 72 protrudes from the solenoid 73, the fork portion 71*c* of the control lever 71 that sandwiches the constricted portion 72*a* of the plunger 72 is pushed up, and the control lever 71 rotates clockwise about the shaft 71*a*, which moves the pin 71*b* of the control lever 71 downward. At this time, the pin 71*b* catches the frame portion 37*a* on the right side of the swing lever 37, which pulls down the right side of the swing lever 37, and the swing lever 37 is thus rotated clockwise opposing the biasing force of the spring 38. Accordingly, the swing lever 37 is separated from the circumferential surface of the eccentric cam 36. Specifically, in the present embodiment, the solenoid 73, the plunger 72, the control lever 71, the shaft 71*a*, and the pin 71*b* constitute a separating portion that separates the swing lever 37 from the circumferential surface of the eccentric cam 36.

In the state where the swing lever 37 is separated from the circumferential surface of the eccentric cam 36, the state where the swing lever 37 is stopped is maintained even if the eccentric cam 36 rotates.

Accordingly, the swing lever 37 is brought into contact with or separated from the circumferential surface of the eccentric cam 36 by energizing or de-energizing the solenoid 73, which enables the swing lever 37 to swing or the swinging thereof to be stopped. Consequently, the rollers 22 and 23 for the web sheet 21 can be rotated or the rotation of the rollers 22 and 23 for the web sheet 21 can be stopped.

For example, during a warm-up period when the image forming apparatus 1 is turned on and a standby period thereof, even if the rollers 11 and 12 for fixing are rotated, it is not necessary to take up and feed out the web sheet 21, and thus the swing lever 37 is separated from the circumferential surface of the eccentric cam 36, which stops the swinging of the swing lever 37, and the rotation of the rollers 22 and 23 for the web sheet 21 is thus stopped.

Further, the greater the number of recording sheets to be printed, the print processing time period, or the amount of toner consumption, the more a portion of the web sheet 21 in the nip region between the pressing roller 25 and the pressure roller 11 becomes smeared. Thus, depending on the number of recording sheets to be printed, the print processing time period, and the amount of toner consumption, the solenoid 73 is energized for a predetermined operating time period, the swing lever 37 is caused to swing, the rollers 22 and 23 for the web sheet 21 are rotated, and the web sheet 21 is taken up and fed out. For example, every time the number of sheets to be printed is increased by 10, the solenoid 73 is energized for a predetermined operating time period, the swing lever 37 is caused to swing, the rollers 22 and 23 for the web sheet 21 are rotated, and the web sheet 21 is taken up by a fixed amount.

Moreover, when the wound diameter of the web sheet 21 on the take-up roller 23 increases, and the speed to take up the web sheet 21 by the take-up roller 23 is accelerated, the amount by which the web sheet 21 is taken up and fed out becomes excessively large, and thus the operating time period of the rollers 22 and 23 for the web sheet 21 is shortened as appropriate (alternatively, a stop time period of the swing lever 37 is set, and taking up and feeding out of the web sheet 21 are halted), thereby adjusting the amount by which the web sheet 21 is taken up.

As described above, if the rotational speed of the rollers 22 and 23 for the web sheet 21 changes due to a change in the rotational speed of the rollers 11 and 12 for fixing, or if the rotational speed of the take-up roller 23 changes due to a change in the distance between the shafts of the rollers 11 and 12 for fixing (the switching between the pressing state and the pressure canceled state), the rotational speed of the rollers 22 and 23 for the web sheet 21 changes, and thus the accurate amount by which the web sheet 21 is taken up is no longer maintained. Accordingly, the amount by which the web sheet 21 is taken up is adjusted by changing the operating time period (rotating time period) of the rollers 22 and 23 for the web sheet 21 as appropriate.

The following is a detailed description of the configuration for controlling the swing lever 37 and the rollers 22 and 23 for the web sheet 21 to operate and stop.

Figure 10:
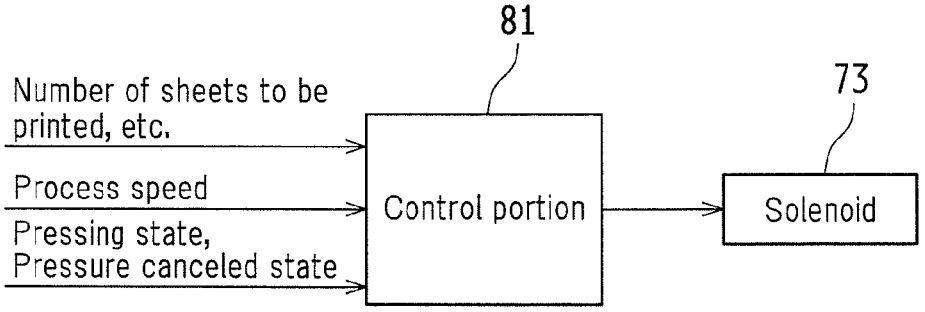
FIG. 10 is a block diagram showing a schematic configuration of a control system of the fixing apparatus according to the embodiment of the present invention.

FIG. 10 is a block diagram showing a control system that performs such control. In FIG. 10, a control portion 81 is mounted in the fixing apparatus 4, and controls the fixing apparatus 4. The control portion 81 brings the swing lever 37 into contact with the circumferential surface of the eccentric cam 36 or separates the swing lever 37 therefrom by energizing or de-energizing the solenoid 73, for example.

A main control portion (not shown) on the image forming apparatus 1 side gives a power-on warm-up or standby setting instruction to the control portion 81. Under such a setting, the de-energizing state of the solenoid 73 is maintained, so that the swing lever 37 is separated from the circumferential surface of the eccentric cam 36, which stops the swinging of the swing lever 37, and stops the rotation of the rollers 22 and 23 for the web sheet 21. Accordingly, wasteful taking up and feeding out of the web sheet 21 are suppressed.

The control portion 81 obtains the number of recording sheets to be printed, a print processing time period, the amount of toner consumption, and the like from the main control portion (not shown) on the image forming apparatus 1 side, sets a predetermined operating time period based on these, and energizes the solenoid 73 for this predetermined operating time period. This causes the swing lever 37 to come into contact with the circumferential surface of the eccentric cam 36 and the swing lever 37 to swing, thereby rotating the rollers 22 and 23 for the web sheet 21. Consequently, the web sheet 21 is taken up and fed out. For example, every time the number of sheets to be printed is increased by 10, the solenoid 73 is energized for an operating time period T, which causes the swing lever 37 to swing, and the rollers 22 and 23 for the web sheet 21 are thus rotated. As a result, the web sheet 21 is taken up by a substantially fixed amount.

The control portion 81 adds the operating time periods T of the rollers 22 and 23 for the web sheet 21 so as to obtain a cumulative total operating time period, and obtains a total amount by which the web sheet 21 is taken up and that corresponds to this cumulative total operating time period. The control portion 81 obtains the wound diameter of the web sheet 21 on the take-up roller 23 based on this total take-up amount, and an increase in the speed at which the web sheet 21 is taken up based on this wound diameter, and corrects and shortens the operating time period T according to this speed increase. Actually, a table is stored in advance in which the cumulative total operating time period of the rollers 22 and 23 for the web sheet 21 and a coefficient $\alpha$ (<1) are associated with each other, and the coefficient $\alpha$ corresponding to this cumulative total operating time period is obtained with reference to this table. Then, a value calculated by multiplying the obtained coefficient $\alpha$ by the operating time period T is assumed to be the corrected operating time period T. Accordingly, even if the wound diameter of the web sheet 21 on the take-up roller 23 increases, the amount by which the web sheet 21 is taken up during the operating time period T is maintained fixed.

Further, when performing print processing, the control portion 81 obtains, from the main control portion (not shown) on the image forming apparatus 1 side, the process speed (rotational speed of the rollers 11 and 12 for fixing), and information indicating whether the pressing state or the pressure canceled state (for a recording sheet having a normal thickness, a thick envelope, or the like) is set, corrects the operating time period T according to the process speed and the information indicating whether the pressing state or the pressure canceled state is set, and obtains the corrected operating time period T. Accordingly, irrespective of the process speed and whether the pressing state or the pressure canceled state is set, it is possible to maintain the appropriate amount by which the web sheet 21 is taken up by maintaining the number of rotations of the rollers 22 and 23 for the web sheet 21 during the operating time period T substantially fixed.

Especially, in the fixing apparatus 4 according to the present embodiment, the rollers 11 and 12 for fixing and the rollers 22 and 23 for the web sheet 21 are caused to operate in conjunction with each other using the eccentric cam 36, the swing lever 37, and the one way clutch 41. Thus, the rotational speed of the rollers 22 and 23 for the web sheet 21 changes, depending on the process speed (rotational speed of the rollers 11 and 12 for fixing) and whether the pressing state or the pressure canceled state is set. Accordingly, it is necessary to maintain the appropriate amount by which the web sheet 21 is taken up by suppressing the change in the number of rotations of the rollers 22 and 23 for the web sheet 21 during the operating time period T, by correcting the operating time period T in such a way.

Figure 11:
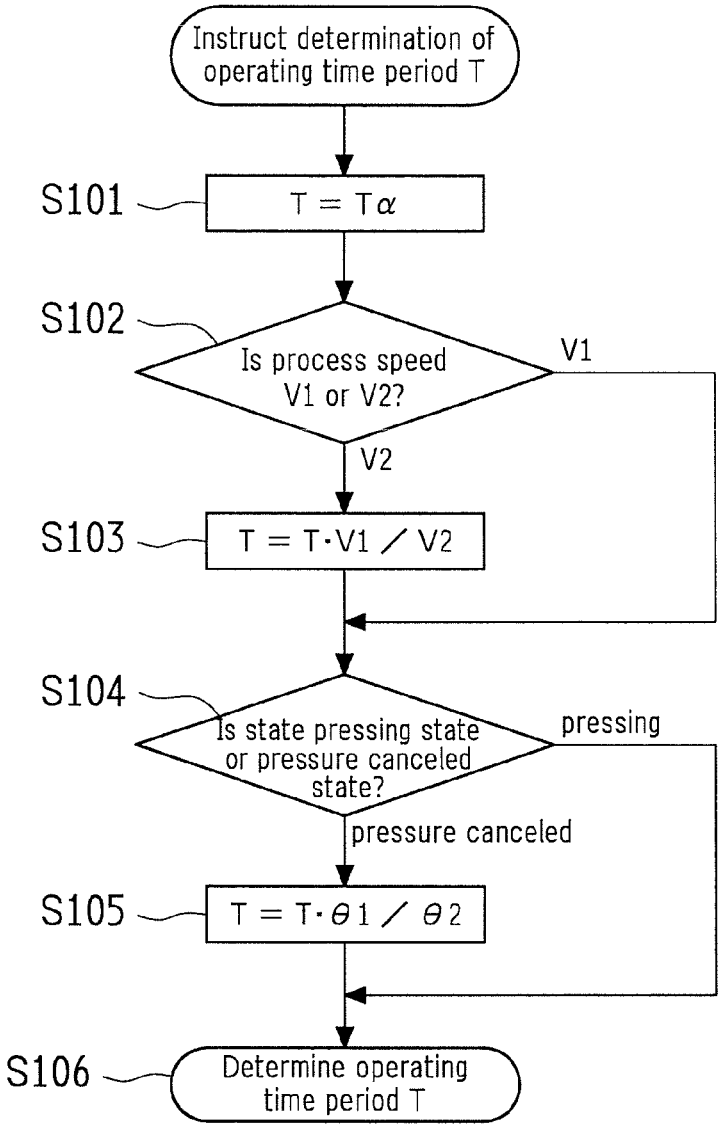
FIG. 11 is a flowchart showing a procedure of correcting an operation time period of web sheet rollers in the fixing apparatus according to the embodiment of the present invention.

The following is a description of a procedure for correcting the operating time period T of the rollers 22 and 23 for the web sheet 21, with reference to the flowchart in FIG. 11.

First, as described above, the control portion 81 adds up the operating time periods of the rollers 22 and 23 for the web sheet 21, and obtains the cumulative total operating time period. Next, the control portion 81 obtains the coefficient $\alpha$ corresponding to that cumulative total operating time period with reference to the table in which the cumulative total operating time period of the rollers 22 and 23 for the web sheet 21 and the coefficient $\alpha$ (<1) are associated with each other. Then, a value calculated by multiplying the obtained coefficient $\alpha$ by the fixed operating time period T is assumed to be the corrected operating time period T (step S101).

Subsequently, the control portion 81 obtains either a first process speed V1 or a second process speed V2 from the main control portion (not shown) on the image forming apparatus 1 side (step S102). For example, the first process speed V1 is assumed to be a process speed when printing a monochrome image. Further, the second process speed V2 is assumed to be a process speed when printing a color image, and the first process speed V1 is assumed to be set faster than the second process speed V2 (V1>V2).

Generally, there are many cases where the first process speed V1 is set, and thus the operating time period T obtained in step S101 is a time period for operating at the first process speed V1. Accordingly, if the control portion 81 obtains the first process speed V1 ("V1" in step S102), the control portion 81 transitions to step S104 without correcting the operating time period T.

Further, if the control portion 81 obtains the second process speed V2 ("V2" in step S102), the control portion 81 obtains a value (T·V1/V2) calculated by multiplying the operating time period T obtained in step S101 by V1/V2, and sets this value as the corrected operating time period T (step S103).

When the second process speed V2 is set, the rotational speed of the rollers 11 and 12 for fixing decreases compared with the time when the first process speed V1 is set, the rotational speed of the rollers 22 and 23 for the web sheet 21 also decreases following this, and thus the amount by which the web sheet 21 is taken up per unit time decreases. However, the operating time period T is corrected so as to be longer by being multiplied by V1/V2, which suppresses a change in the number of rotations of the rollers 22 and 23 for the web sheet 21 during the operating time period T, and the amount by which the web sheet 21 is taken up is thereby maintained substantially fixed.

Next, the control portion 81 obtains information indicating whether the pressing state or the pressure canceled state is set from the main control portion (not shown) on the image forming apparatus 1 side (step S104).

Normally, the pressing state is set, and thus the operating time period T obtained in step S101 or S103 is a time period for operating in the pressing state. Accordingly, if the control portion 81 obtains information indicating that the pressing state has been set ("pressing" in step S104), the control portion 81 does not correct the operating time period T, and transitions to step S105.

Further, if the control portion 81 obtains information indicating that the pressure canceled state has been set ("pressure canceled" in step S104), the control portion 81 obtains a value calculated by multiplying a value calculated by dividing a swing angle $\theta$1 of the swing lever 37 in the pressing state by a swing angle $\theta$2 of the swing lever 37 in the pressure canceled state by the operating time period T obtained in step S101 or S103 (in other words, T·$\theta$1/$\theta$2), and sets this value as the corrected operating time period T (step S105). As shown in FIGS. 8A and 8B, the swing angle $\theta$1 of the swing lever 37 in the pressing state is 15°, the swing angle $\theta$2 of the swing lever 37 in the pressure canceled state is 7.5°, and thus the operating time period T in the pressure canceled state is twice as long as the operating time period T obtained in step S101 or S103.

When the pressure canceled state is set, compared with the time when the pressing state is set, the swing angle of the swing lever 37 is halved, and the rotational speed of the rollers 22 and 23 for the web sheet 21 is also halved. However, since the operating time period T has been corrected so as to be doubled, a change in the number of rotations of the rollers 22 and 23 for the web sheet 21 during the operating time period T is suppressed, and the amount by which the web sheet 21 is taken up is maintained substantially fixed.

Moreover, if the first process speed V1 is set, the operating time period T obtained in step S101 or S105 is corrected to a time period that is longer than or equal to the operating time period T and closest to the operating time period T and that corresponds to an integral multiple of a time period necessary for the eccentric cam 36 to make one full rotation at the first process speed V1, and the operating time period T is determined (step S106).

Alternatively, in the case where the second process speed V2 is set, assuming that t2 is a time period necessary for the eccentric cam 36 to make one full rotation at the second process speed V2, the operating time period T obtained in step S103 or S105 is corrected to a time period that is longer than or equal to the operating time period T and closest to the operating time period T, and that corresponds to an integral multiple of the time t2, and the operating time period T is determined (step S106).

Accordingly, the rotation angle of the eccentric cam 36 while the eccentric cam 36 is stopped is fixed, the taking up of the web sheet 21 is stopped when the angle of the swing lever 37 has reached a fixed angle, and thus variations in the amount by which the web sheet 21 is taken up are suppressed.

The correction of the operating time period T ends in this way, and thereafter the control portion 81 energizes the solenoid 73 for the operating time period T so as to swing the swing lever 37, and thus rotates the rollers 22 and 23 for the web sheet 21, thereby taking up the web sheet 21 by a fixed amount.

Such derivation of the operating time period T and rotation of the rollers 22 and 23 for the web sheet 21 during the operating time period T are performed every time the number of sheets to be printed is increased by 10, and the web sheet 21 is taken up by a fixed amount each time.

Thus, in the fixing apparatus 4 according to the present embodiment, the rotation of the eccentric cam 36 causes the swing lever 37 to swing, the swinging of the swing lever 37 becomes intermittent rotation in one way and transmitted via the first one way clutch 41, and thus a great speed reducing ratio can be obtained.

In both the pressure canceled state and the pressing state (specifically, even if the position of the second frame 64 relative to the first frame 61 is displaced, the position of the shaft 23*a* of the take-up roller 23 relative to the shaft 12*a* of the hot roller 12 is thereby displaced, and thus the positional relationship between the eccentric cam 36 and the swing lever 37 changes), since the swing lever 37 is in slide contact with the eccentric cam 36, the swing lever 37 swings following the rotation of the eccentric cam 36, and a rotation drive force is transmitted from the eccentric cam 36 to the swing lever 37, thereby enabling the take-up roller 23 to rotate.

Moreover, according to the process speed (rotational speed of the rollers 11 and 12 for fixing) or whether the pressing state or the pressure canceled state is set, even if the rotational speed of the rollers 22 and 23 for the web sheet 21 changes, the appropriate amount by which the web sheet 21 is taken up can be maintained by suppressing a change in the number of rotations of the rollers 22 and 23 during the operating time period T by correcting the operating time period T of the rollers 22 and 23.

Note that although the pressure roller 11 and the hot roller 12 are pressed against each other via the fixing belt 14 in the above embodiment, the present invention is also applicable to a configuration in which the pressure roller (fixing rotation member) 11 and the hot roller (fixing rotation member) 12 are directly pressed against each other.

The present invention may be embodied in various other forms without departing from the gist or essential characteristics thereof. Therefore, the embodiments disclosed in this application are to be considered in all respects as illustrative and not limiting. The scope of the invention is indicated by the appended claims rather than by the foregoing description. All variations and modifications that come within the meaning and range of equivalency of the claims are intended to be embraced therein.

DESCRIPTION OF REFERENCE NUMERALS

1 Image forming apparatus
2 Photosensitive drum
3 Transfer belt
4 Fixing apparatus
11 Pressure roller (Second fixing rotation member)
12 Hot roller (First fixing rotation member)
13 Hot assist roller
14 Fixing belt
21 Web sheet (Cleaning web sheet)
22 Feed-out roller (Cleaning web sheet roller)
23 Take-up roller (Cleaning web sheet roller)
24 Tension roller
25 Pressing roller
36 Eccentric cam
37 Swing lever
38 Spring
41 First one way clutch
42 Second one way clutch
43 Third one way clutch
61 First frame
62 First unit frame
63 Second unit frame
64 Second frame
71 Control lever
72 Plunger
73 Solenoid
74 Spring
81 Control portion
GU Rotation transmission unit

What is claimed is:

1. A fixing apparatus, comprising:
a fixing rotation member;
a rotation drive portion that rotates the fixing rotation member;
a cleaning web sheet that cleans a circumferential surface of the fixing rotation member;
a cleaning web sheet roller that takes up or feeds out the cleaning web sheet;
a swing cam that is rotationally driven by the rotation drive portion;
a rotation transmission portion that transmits a rotation drive force to the cleaning web sheet roller;
a one way clutch that is provided on an input shaft of the rotation transmission portion;
a swing lever that is connected to the one way clutch and biased so as to be brought into slide contact with the swing cam; and
a separating portion that separates the swing lever from the swing cam,
wherein if the swing cam is rotated by the rotation drive portion, the swing lever that is in slide contact with the swing cam repeatedly swings, the swinging of the swing lever is transmitted as an intermittent one-way rotation to the input shaft of the rotation transmission portion via the one way clutch, and the intermittent rotation is transmitted to the cleaning web sheet roller via the rotation transmission portion.

2. An image forming apparatus comprising the fixing apparatus according to claim 1.

3. A fixing apparatus, comprising:
a first fixing rotation member and a second fixing rotation member that are pressed against each other;
a rotation drive portion that rotates at least one of the first and second fixing rotation members;
a cleaning web sheet that cleans a circumferential surface of the first or second fixing rotation member;
a cleaning web sheet roller that takes up or feeds out the cleaning web sheet;
a swing cam that is rotationally driven by the rotation drive portion;
a rotation transmission portion that transmits a rotation drive force to the cleaning web sheet roller;
a one way clutch that is provided on an input shaft of the rotation transmission portion;
a swing lever that is connected to the one way clutch and biased so as to be brought into slide contact with the swing cam;
a first frame that rotatably supports the first fixing rotation member; and
a second frame that rotatably supports the second fixing rotation member, wherein the second frame is supported displaceably with respect to the first frame, enabling switching between a pressing state and a pressure canceled state of the first and second fixing rotation members, the first frame is provided with the swing cam, the second frame is provided with the swing lever, and the swing lever of the second frame is in slide contact with the swing cam of the first frame when the second frame is attached to the first frame, and if the swing cam is rotated by the rotation drive portion, the swing lever that is in slide contact with the swing cam repeatedly swings, the swinging of the swing lever is transmitted as an intermittent one-way rotation to the input shaft of the rotation transmission portion via the one way clutch, and the intermittent rotation is transmitted to the cleaning web sheet roller via the rotation transmission portion.

4. The fixing apparatus according to claim 3, wherein the second frame is provided with a separating portion that separates the swing lever from the swing cam.

5. The fixing apparatus according to claim 3, wherein the second frame is provided with the swing lever, the one way clutch, the rotation transmission portion, and the cleaning web sheet roller.

6. An image forming apparatus comprising the fixing apparatus according to claim 3.

7. A fixing apparatus, comprising:

two fixing rotation members that are pressed against each other;

a cleaning web sheet that cleans a circumferential surface of at least one of the fixing rotation members;

a cleaning web sheet roller that takes up or feeds out the cleaning web sheet;

a rotation drive portion that rotates at least one of the fixing rotation members;

a swing cam that is rotationally driven by the rotation drive portion;

a rotation transmission portion that transmits a rotation drive force to the cleaning web sheet roller;

a one way clutch that is provided on an input shaft of the rotation transmission portion;

a swing lever that is connected to the one way clutch and biased so as to be brought into slide contact with the swing cam;

a separating portion that separates the swing lever from the swing cam; and a control portion that controls the separating portion, wherein if the swing cam is rotated by the rotation drive portion, the swing lever that is in slide contact with the swing cam repeatedly swings, the swinging of the swing lever is transmitted as an intermittent one-way rotation to the input shaft of the rotation transmission portion via the one way clutch, and the intermittent rotation is transmitted to the cleaning web sheet roller via the rotation transmission portion, and the control portion adjusts, by controlling the separating portion, a time period during which the swing lever is separated from the swing cam or a time period during which the swing lever is in slide contact with the swing cam.

8. The fixing apparatus according to claim 7, wherein the control portion changes the time period during which the swing lever is separated from the swing cam or the time period during which the swing lever is in slide contact with the swing cam according to a rotational speed of the fixing rotation members.

9. The fixing apparatus according to claim 8, wherein the faster the rotational speed of the fixing rotation members is, the more the control portion extends the time period during which the swing lever is separated from the swing cam or shortens the time period during which the swing lever is in slide contact with the swing cam.

10. The fixing apparatus according to claim 7, wherein switching between a pressing state and a pressure canceled state of the fixing rotation members is possible, the swing lever is in slide contact with the swing cam irrespective of the pressing state or the pressure canceled state, the swing lever that is in slide contact with the swing cam repeatedly swings if the swing cam is rotated by the rotation drive portion, the swinging of the swing lever is transmitted as an intermittent one-way rotation to the input shaft of the rotation transmission portion via the one way clutch, and the intermittent rotation is transmitted to the cleaning web sheet roller via the rotation transmission portion, and the control portion changes, depending on which of the pressing state and the pressure canceled state is switched to and set, a time period during which the swing lever is separated from the swing cam or a time period during which the swing lever is in slide contact with the swing cam.

11. The fixing apparatus according to claim 7, wherein the control portion changes the time period during which the swing lever is separated from the swing cam or the time period during which the swing lever is in slide contact with the swing cam, in accordance with a wound diameter of the cleaning web sheet roller.

12. The fixing apparatus according to claim 7, wherein the time period during which the swing lever is separated from the swing cam is a time period with which the number of rotations of the swing cam becomes an integer.

13. An image forming apparatus comprising the fixing apparatus according to claim 7.

* * * * *